US006915624B2

(12) United States Patent
Shibazaki et al.

(10) Patent No.: US 6,915,624 B2
(45) Date of Patent: Jul. 12, 2005

(54) AUTOMATIC BANDING PACKING MACHINE

(75) Inventors: Tokio Shibazaki, Kawasaki (JP); Kenichi Enda, Kawasaki (JP); Yoshikatsu Aizawa, Kawasaki (JP); Saburo Tsurumaki, Chiba (JP); Mitsuru Sato, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 10/652,022

(22) Filed: Aug. 29, 2003

(65) Prior Publication Data

US 2004/0040266 A1 Mar. 4, 2004

(30) Foreign Application Priority Data

Sep. 2, 2002 (JP) ..... 2002-256779

(51) Int. Cl.[7] ..... B65B 13/00
(52) U.S. Cl. ..... 53/588; 53/589; 53/389.2
(58) Field of Search ..... 53/588, 589, 582, 53/389.2, 389.3

(56) References Cited

U.S. PATENT DOCUMENTS 4,850,179 A 7/1989 Takami
4,850,180 A * 7/1989 Takami ..... 53/589
4,912,912 A 4/1990 Tagomori
5,155,982 A 10/1992 Boek et al.
5,379,576 A * 1/1995 Koyama ..... 53/589
5,414,980 A * 5/1995 Shibazaki et al. ..... 53/589
5,615,538 A 4/1997 Miyashita et al.

FOREIGN PATENT DOCUMENTS

EP 1 170 214 A1 1/2002
EP 1 207 104 A1 5/2002
JP 10-305812 A 11/1998
JP 2000-142611 A 5/2000

* cited by examiner

*Primary Examiner*—Sameh H. Tawfik
(74) *Attorney, Agent, or Firm*—Webb Ziesenheim Logsdon Orkin & Hanson, P.C.

(57) ABSTRACT

It is an object to provide an automatic banding packing machine capable of easily removing the ring of a band with a simple structure when idle banding is carried out. When the rear end side of a band is to be pulled back by band pull-back means (84), an amount of the pull-back is detected by detecting means. It is decided that idle banding of the band is carried out when a result of the detection is greater than a preset length and the band is wound around a slide table. Thereafter, the rotation of a cam shaft (41) is temporarily stopped based on a signal, whereby the timing of the pressing to be carried out by a middle presser member, which is operated after melting the superposing portion of the band by means of a heater (36), is delayed in a predetermined time.

1 Claim, 8 Drawing Sheets

AUTOMATIC BANDING PACKING MACHINE

BACKGROUND OF THE INVENTION

1. Field of the Invention

The present invention relates to an automatic banding packing machine and more particularly to an automatic banding packing machine capable of easily removing a band wounded directly around a slide table when so-called idle banding is carried out in a state in which an article to be packed is not put on the slide table.

2. Description of the Related Art

For example, in an automatic banding packing machine 20 of a full automatic type, a band guide arch 22 is provided above a packing machine body 21 as shown in FIGS. 8 and 9. Furthermore, a band reel 25 upon which a band is wound in a large amount is provided on the side surface of the packing machine body 21.

A part of the band transferred from the band reel 25 into a pool box 24 is fed into the band guide arch 22 by the rotating force of band feeding means 30 comprising for example, a pair of rollers. The band is then pulled back by band pull-back means 31 and a band B is further tightened by band tightening means 32.

Thereafter, a heater 33 is inserted into the superposing portion of the band B to be freely taken in/out. Consequently, the surface of the band B is molten and the heater 33 retreats from the vicinity of a slide table 34. Then, a vertically movable middle presser 35 positioned in a lower part is moved upward. Thus, the band is pressed between the middle presser 35 and the slide table 34 so that the superposing portion of the band is fixed by pressure.

If the banding work is carried out in a state in which an article M to be packed is not put on the upper surface of the packing machine body 21, that is, the slide table 34, the band B forms a small ring and is directly wound around the slide table 34.

Also in the case in which the article M to be packed is not present or a starting switch is pressed by mistake, such idle banding is carried out. In that case, the ring of the band is to be cut away from the slide table 34.

However, such a band B is tightly wound around the slide table 34. Therefore, there is a problem in that scissors are to be prepared and the tips of the scissors enter with difficulty so that a great deal of time and labor is required.

In order to solve such a problem, conventionally, when idle banding is detected, a packing work is ended without tightening a band after pulling back the band. Thereafter, the ring of the band is removed (see Japanese Laid-Open Patent Publication No. 2000-142611).

On the other hand, as disclosed in Japanese Laid-Open Patent Publication No. Hei. 10 (1998)-305812, a bar for welding prevention is protruded to impede the progress of a heater when idle banding is carried out.

However, in the method of removing a band described in the Japanese Laid-Open Patent Publication No. 2000-142611, the ring of the band remains in a band guide arch. For this reason, a great deal of time and labor is required for the removing work, which has been required to be improved.

Moreover, in Japanese Laid-Open Patent Publication No. Hei. 10 (1998)-305812, a bar for welding prevention is newly provided to remove a band. Thus, there is a problem in that another member is required, resulting in an increase in cost.

SUMMARY OF THE INVENTION

In consideration of such actual circumstances, it is an object of the present invention to provide an automatic banding packing machine capable of easily removing the ring of a band with a simple structure when idle banding is carried out.

In order to attain the object, the present invention provides an automatic banding packing machine in which at a step of feeding a tip portion of a band to a band guide arch by band feeding means and then causing a right presser member, a left presser member and a middle presser member, which are arranged straight below a slide table, to approach or separate from the slide table in a predetermined timing by a rotation of a cam shaft, the tip portion of the band is clamped by the right presser member, a rear end side of the band is pulled back by band pull-back means in this state, and the band is tightened by band tightening means, and the band is lifted by the middle presser member and is cut by a cutter, and a heater is inserted to freely appear on a superposing portion of the band, thereby melting a surface of the superposing portion of the band and further pressing the rear end side of the band by the middle presser member, wherein when the rear end side of the band is to be pulled back by the band pull-back means, an amount of the pull-back is detected by detecting means, and it is decided that idle banding of the band is carried out when a length of the band thus pulled back is greater than a preset length of the pull-back of the band corresponding to a minimum packed article which can be packed, and the rotation of the cam shaft is temporarily stopped based on a signal, whereby the timing of the pressing to be carried out by the middle presser member after melting the superposing portion of the band by means of the heater is delayed in a predetermined time.

According to the present invention having such a structure, when the idle banding of the band is detected, the surface of the band is still heated by the heater. Thereafter, the rotation of the cam shaft is stopped temporarily. By such a structure, a time required for cooling the surface of the band molten by the heating is maintained.

As a result, with the same structure as before, the band can be prevented from being welded without another member, even if the pressing is carried out by means of the middle presser member after heating the band. In the case in which the idle banding is carried out, accordingly, the band wound around the slide table jumps outward by elastic force thereof, if the middle presser member pressing the lower surface of the band or the like is released from the band.

DESCRIPTION OF THE PREFERRED EMBODIMENTS

An embodiment of the present invention will be described below with reference to the drawings.

Figure 1:
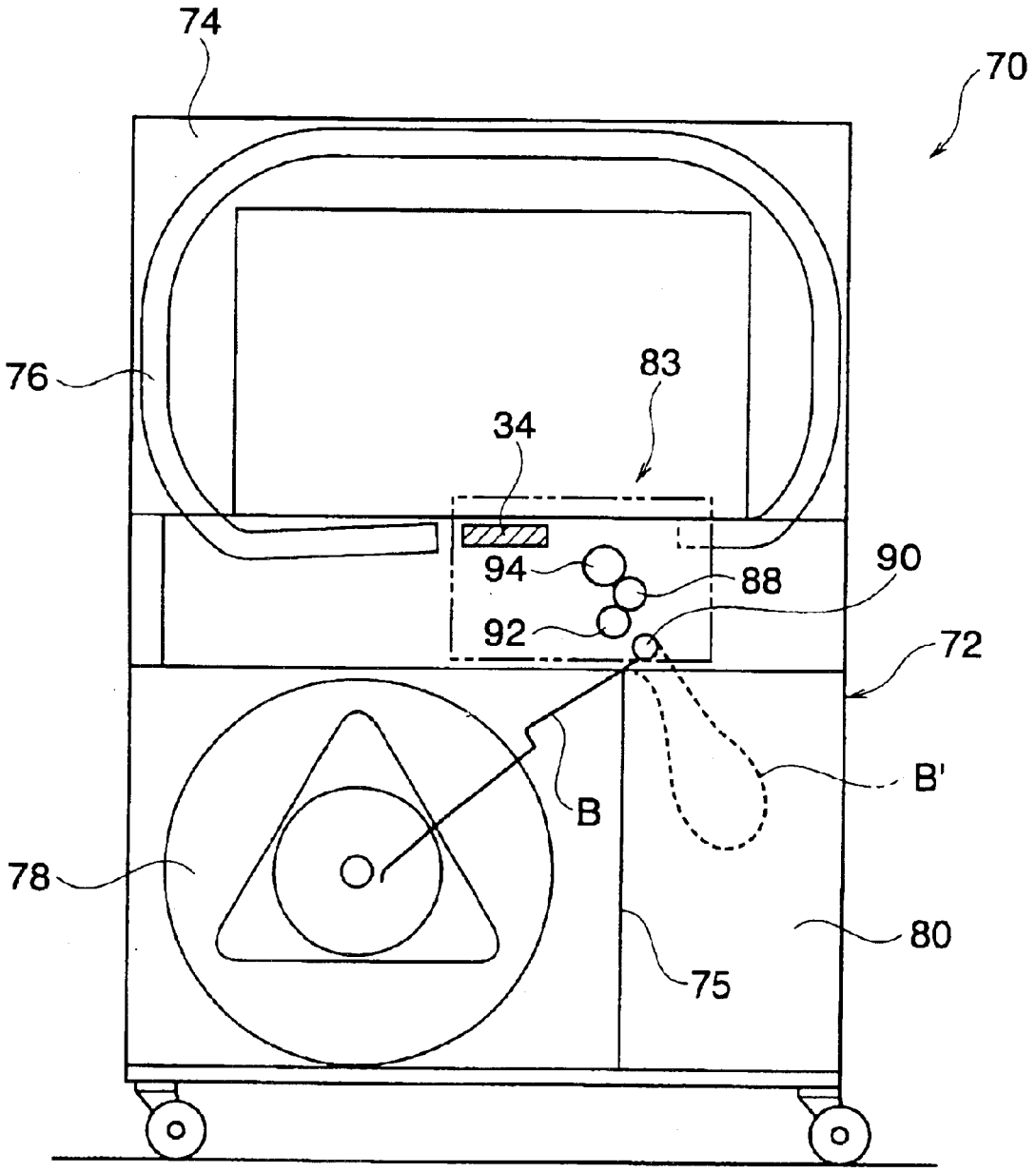
FIG. 1 is a schematic front view showing an automatic banding packing machine according to an embodiment of the present invention.

FIG. 1 shows an automatic banding packing machine according to the embodiment of the present invention.

In an automatic banding packing machine 70, an almost U-shaped band guide arch 74 is provided above a packing machine body 72. In the band guide arch 74, a serial band passage 76 drawing a loop is formed over the packing machine body 72.

On the other hand, a band reel 78 is accommodated to be freely taken in/out in the left half part of the packing machine body 72 in FIG. 1.

While the band reel 78 is accommodated in the packing machine body 72 in the present embodiment, the present invention is not restricted thereto but the band reel 78 can also be provided on the outside of the packing machine body 72.

A back pool box 80 is formed by a partition plate 75 in the right half part of the packing machine body 72.

The back pool box 80 serves to temporarily accommodate a band B pulled back from the band guide arch 74 when one banding is to be carried out.

Figure 2:
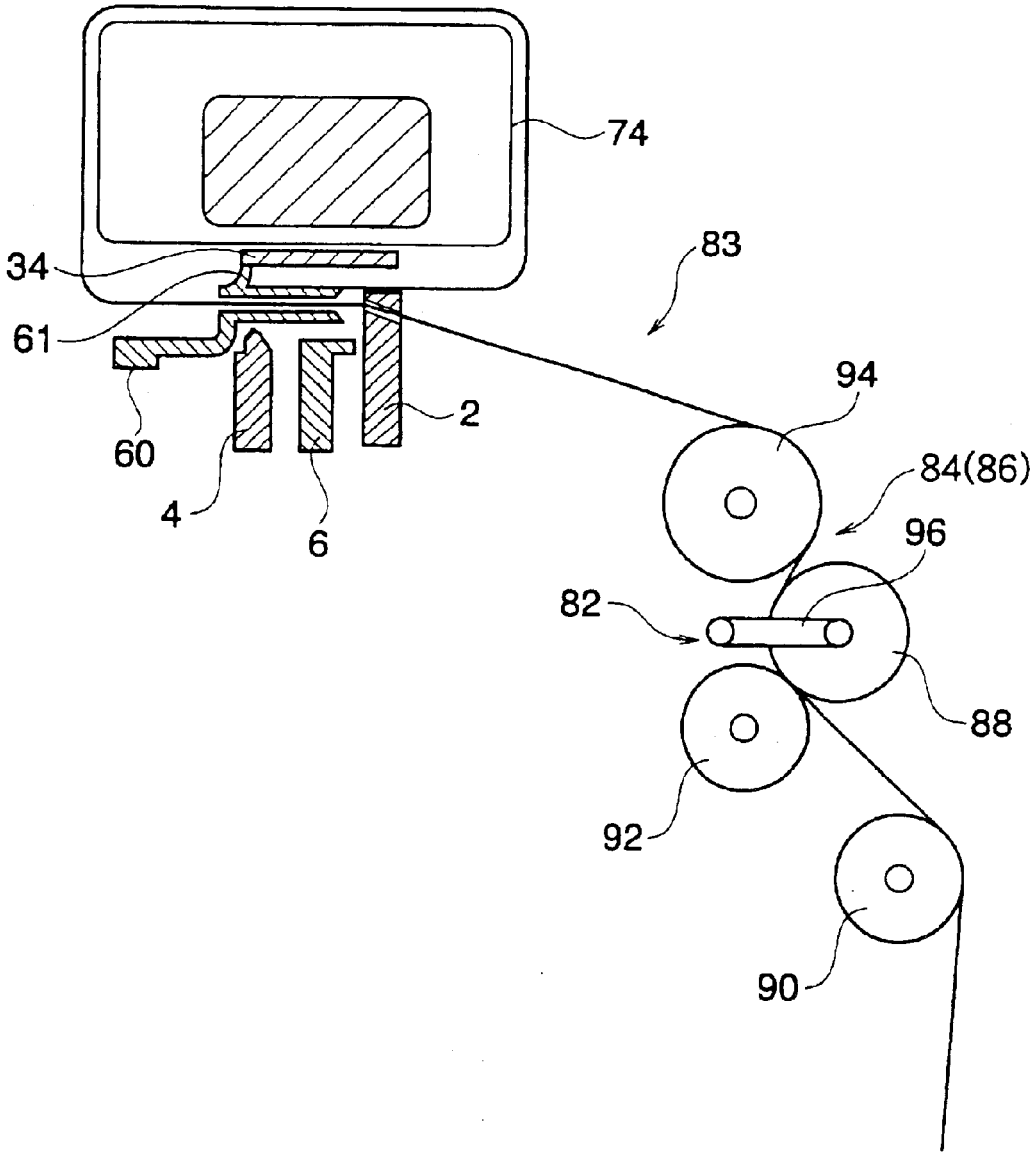
FIG. 2 is a schematic view showing the control portion of the automatic banding packing machine according to the embodiment.

Furthermore, a control portion 83 is constituted between the back pool box 80 and a slide table 34. As shown in FIG. 2, the control portion 83 is provided with band feeding means 82 for feeding a band to the band guide arch 74 side through a guide roller 90, band pull-back means 84 for pulling back the band from the band guide arch 74 side, and band tightening means 86 for tightening the band thus pulled back.

The band pull-back means 84 also serves as the band tightening means 86, and a pair of rollers 94 and 88 constitute these two means. More specifically, the band pull-back means 84 and the band tightening means 86 are constituted by the reverse rotating roller 94 on the driving side and the touch roller 88 on the driven side. The touch roller 88 is shared by selectively coming in contact with the band feeding means 82 on the normal rotating side and the pull-back and tightening means 84 and 86 on the reverse rotating side by pressure.

More specifically, the band feeding means 82 is constituted by a normal rotating roller 92 on the driving side and the touch roller 88 on the driven side. In addition, the band pull-back means 84 and the band tightening means 86 are constituted by the reverse rotating roller 94 on the driving side and the touch roller 88 on the driven side.

The touch roller 88 is supported by a link 96 or an eccentric shaft. When the link 96 is rotated, the touch roller 88 can be caused to come in contact with the normal rotating roller 92 or the reverse rotating roller 94 by pressure. In the case in which the touch roller 88 comes in contact with the normal rotating roller 92 by pressure as shown in FIG. 2, the touch roller 88 separates from the reverse rotating roller 94. To the contrary, when the touch roller 88 comes in contact with the reverse rotating roller 94 by pressure, it separates from the normal rotating roller 92.

Moreover, if the touch roller 88 is caused to come in contact with the reverse rotating roller 94 by pressure, the band can be pulled back and tightened.

Figure 3:
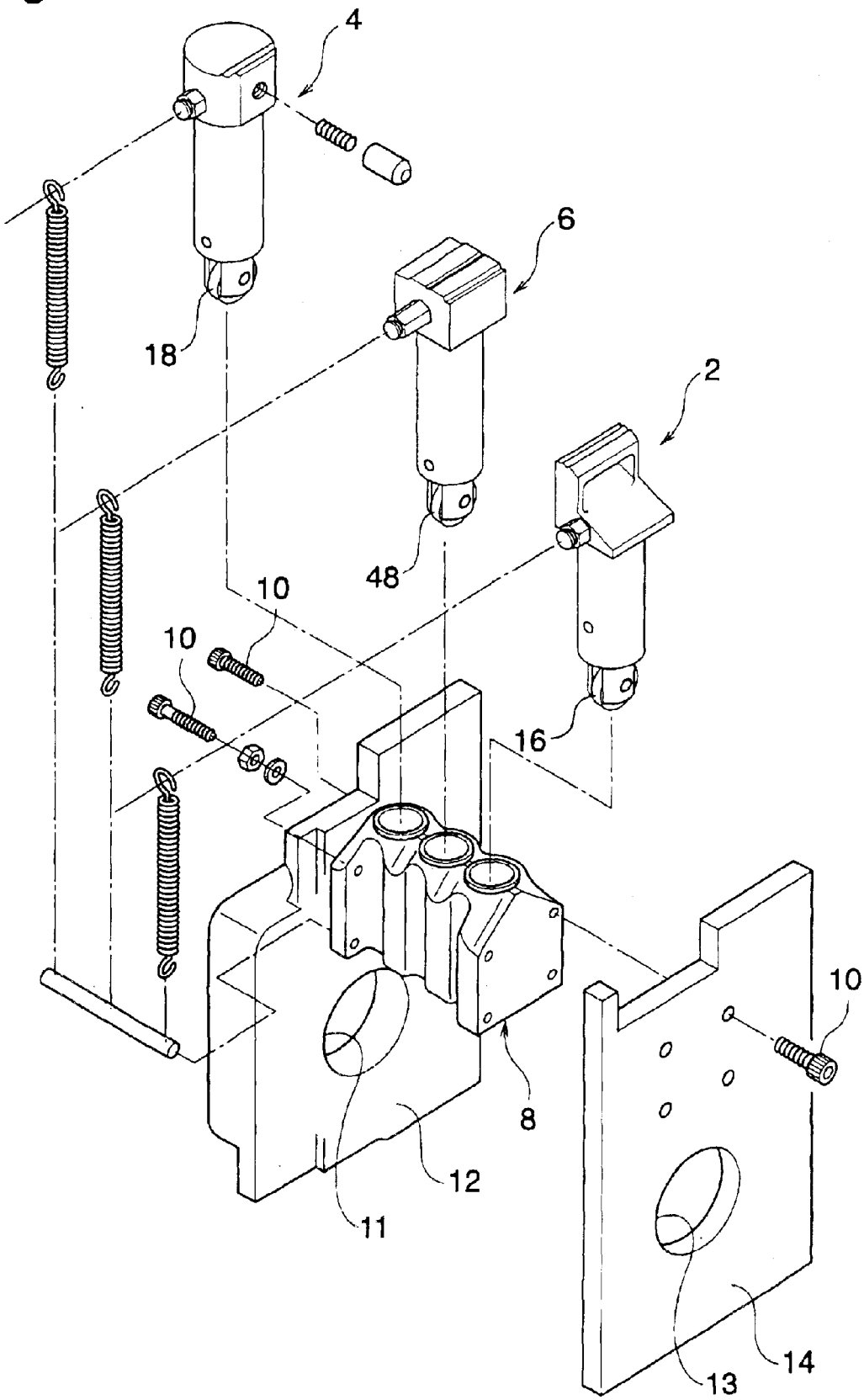
FIG. 3 is an exploded perspective view showing a right presser member, a left presser member and a middle presser member which serve to hold, pull back, cut and weld a band in the automatic banding packing machine according to the embodiment.

FIG. 3 shows the assembly structure of a right presser member 2, a left presser member 4 and a middle presser member 6 which serve to carry out operations for clamping, welding and cutting the tip portion of the band by the action of a cam. These three members are arranged straight below the slide table 34.

More specifically, the right presser member 2, the left presser member 4 and the middle presser member 6 are accommodated in a support block 8, and the support block 8 is supported between a pair of surface plates 12 and 14 with a screw member 10 or the like.

Figure 4:
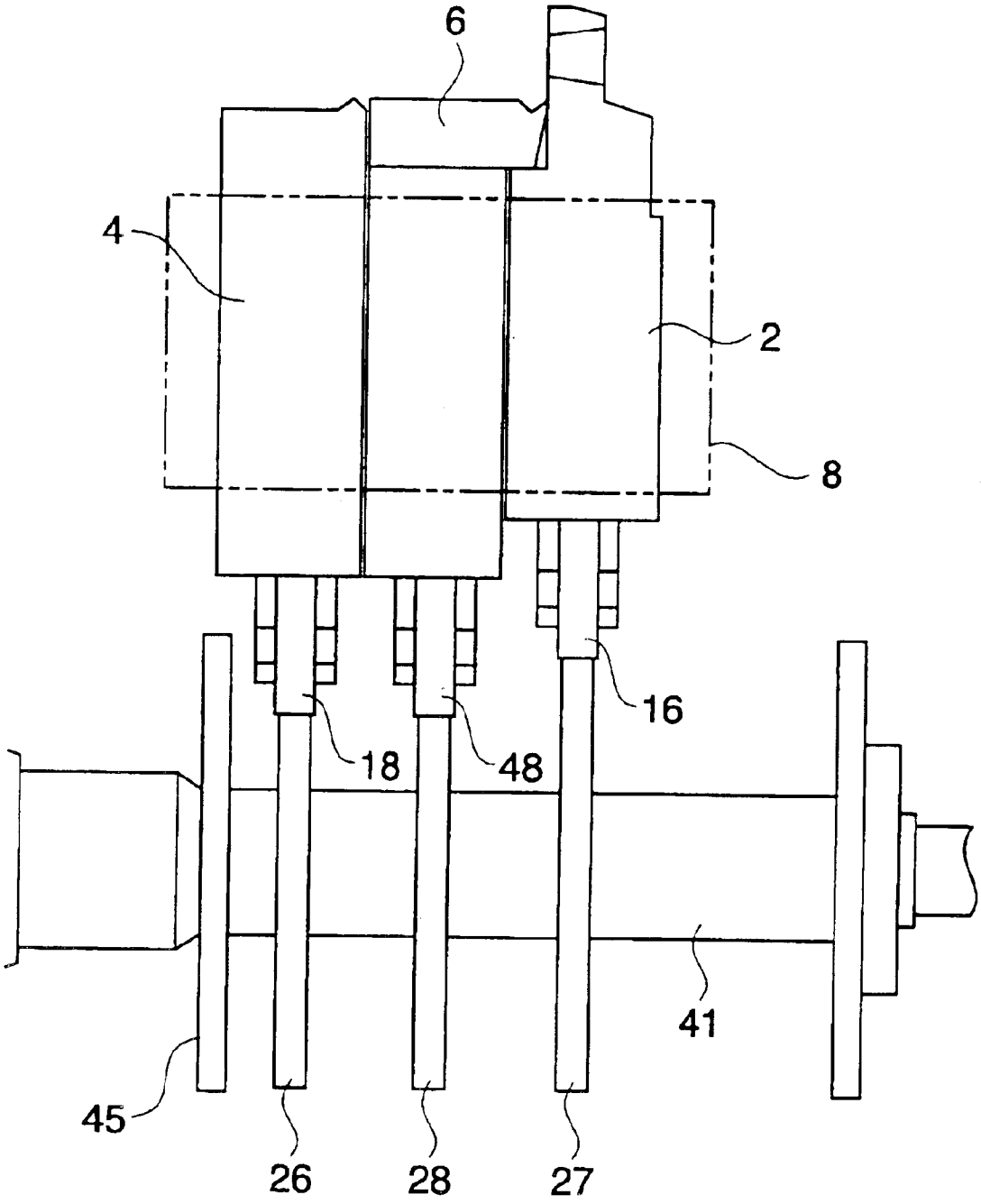
FIG. 4 is a front view showing a state in which the right presser member, the left presser member and the middle presser member illustrated in FIG. 3 are assembled.

On the other hand, a cam shaft 41 is rotatably supported in shaft insertion holes 11 and 13 formed on the surface plates 12 and 14 as shown in FIG. 4. The cam shaft 41 is rotated upon receipt of the force of a driving source such as a motor which is not shown. Cam followers 16, 18 and 48 are attached to the lower parts of the right presser member 2, the left presser member 4 and the middle presser member 6, respectively. These cam followers 16, 18 and 48 abut on the peripheral surfaces of cams 27, 26 and 28 provided on the cam shaft 41. A timing plate 45 is fixed integrally with the cam shaft 41.

Figure 5:
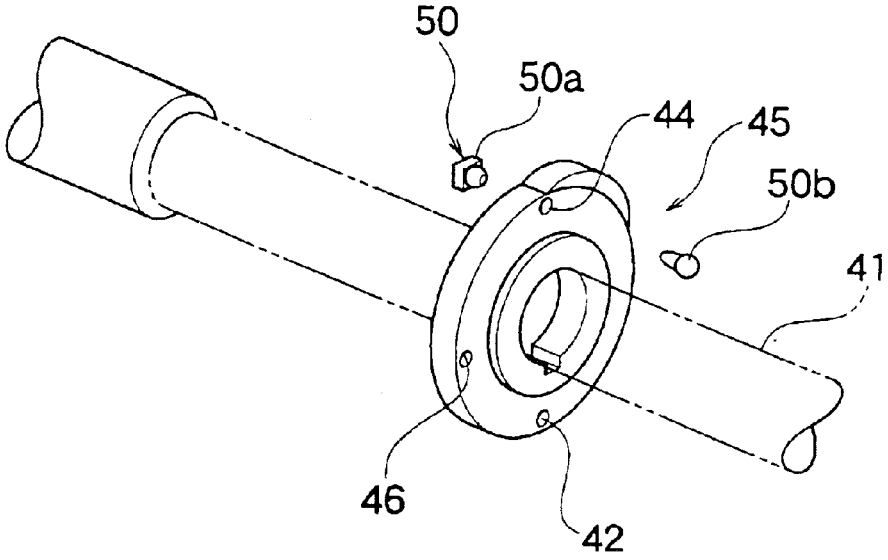
FIG. 5 is a perspective view showing a timing plate fixed to a cam shaft illustrated in FIG. 4.

The timing plate 45 serves to confirm the state of a serial motion of the cams 27, 26 and 28 supported on the cam shaft 41 or members to be operated based thereon when the cams are rotated. For example, as shown in FIG. 5, three holes 42, 44 and 46 are formed apart from each other at a predetermined interval.

The detection of the holes 42, 44 and 46 by an optical sensor 50, which consists of light emission part 50*a* and light receiving part 50*b*, implies that of the start of each step, for example. If the rotation of the cam shaft 41 is caused to stand by when the holes are detected, it is possible to identify the positional relationship between the members when a next step is started.

Furthermore, in the automatic banding packing machine according to the present embodiment, after the band is fed to the band guide arch 74 by the band feeding means 82, the length of the band pulled back is detected by detecting means which will be described below.

More specifically, in order to detect the length of the band pulled back by the band pull-back means 84 after feeding, the following steps may be carried out. Namely, for example, the tip portion of the band is wound like a loop around the band guide arch 74 as shown in FIG. 2 and then abuts on a stopper 61 of a band guide 60 which can freely appear on a band running path in an almost horizontal direction, and by this abutment, a limit switch is turned ON. After this turning ON of the limit switch, by detecting the number of rotations of the touch roller 88 coming in contact with the reverse rotating roller 94 of the band pull-back means 84 by pressure, the above length of the band pulled back can be detected.

If the number of rotations of the touch roller 88 is thus detected and converted into a length, the amount of the band pulled back can be confirmed. Consequently, it is possible to decide whether normal pull-back or idle banding is carried out in the execution of the banding.

Referring to the amount of the pull-back, in the case in which the length of the band pulled back in an actual banding work is greater than a preset length, that is, the length of the amount of the pull-back corresponding to a minimum packed article which can be packed in the automatic banding packing machine, it is decided that the idle banding of the band is carried out.

In the present embodiment, in the case in which the execution of the idle banding is detected by such detecting means, a signal is output to a control device for controlling the control portion 83. Based on the signal, the cam shaft 41 for vertically moving the right presser member 2, the left presser member 4 and the middle presser member 6 shown in FIG. 2 is rotated. By the rotation of the cam shaft 41, the cam followers 16, 18 and 48 are vertically moved in conformity with the shapes of the cams 27, 26 and 28 provided on the cam shaft 41.

Figure 6:
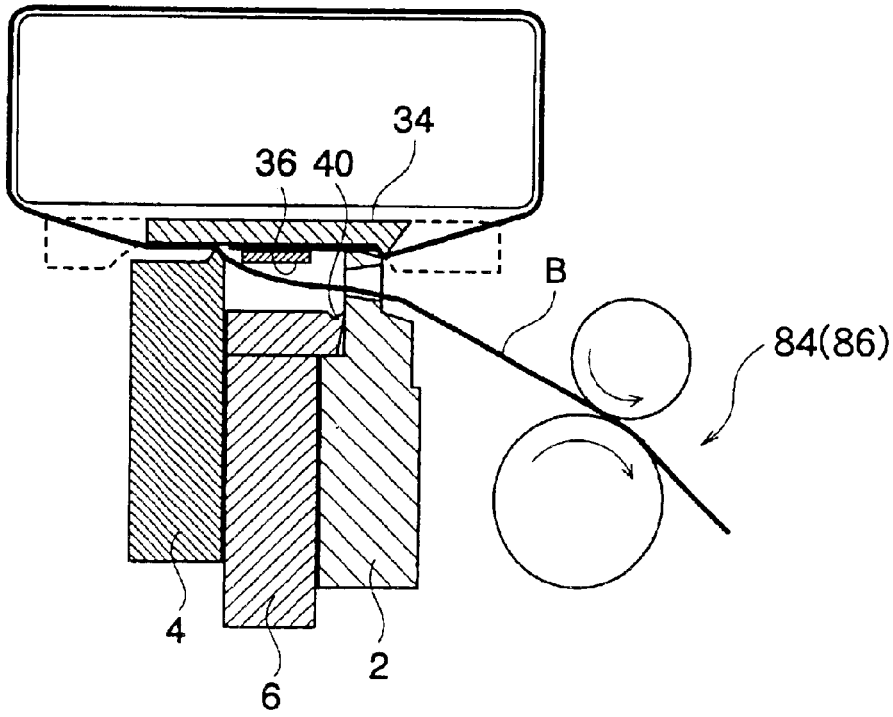
FIG. 6 is a sectional view showing an operation for carrying out banding by the control portion according to the embodiment.

Consequently, the right presser member 2, the left presser member 4 and the middle presser member 6 are vertically moved in a predetermined timing. More specifically, the band is usually pulled back from the band guide arch side as shown in FIG. 6, and secondary tightening is then carried out by the band tightening means 86.

Thereafter, the left presser member 4 is lifted to press the band B with the slide table 34, thereby maintaining the tightening state of the band. Then, the middle presser member 6 provided below is then lifted to cut the band through a cutter 40 and a heater 36 is inserted in the superposing portion of the band in an almost horizontal direction.

As a result, the surface of the band is molten by the heater 36 and the heater 36 melting the surface of the band is moved backward in almost the horizontal direction. Furthermore, the middle presser member 6 is thereafter lifted to press and fix the band B by pressure with the slide table 34.

On the contrary, in the present invention, an idle banding signal is detected by the detecting means as described above. Consequently, the tightening is canceled or is carried out in a constant amount based on the signal, and the band B is then heated by the heater 36 for a predetermined time, and the cam shaft 41 is temporarily stopped.

In the present embodiment, the rotation of the cam shaft 41 is temporarily stopped. As shown in FIG. 6, consequently, a time taken for the middle presser member 6, which is provided below the heater 36, to be lifted from the lower position toward the heater 36 is maintained to be longer than usual.

Therefore, even if the heater 36 is inserted and the surface of the band is molten by the heater 36, the rotation of the cam shaft 41 is then stopped temporarily. As a result, the surface of the band B molten by the heater 36 is cooled before the middle presser member 6 is successively lifted. Thereafter, the middle presser member 6 is moved upward as usual.

In the present embodiment, thus, the rotation of the cam shaft 41 is temporarily stopped when the idle banding is detected. Even if the surface of the band is heated by the heater 36, consequently, the surface of the band is cooled before the middle presser member 6 is lifted to carry out pressing again.

Accordingly, the surface of the band is cooled before the pressing to be carried out by the middle presser member 6. When the heated and molten portion of the band is pressed by the middle presser member 6 in such a state, the band can be prevented from being bonded.

Figure 7:
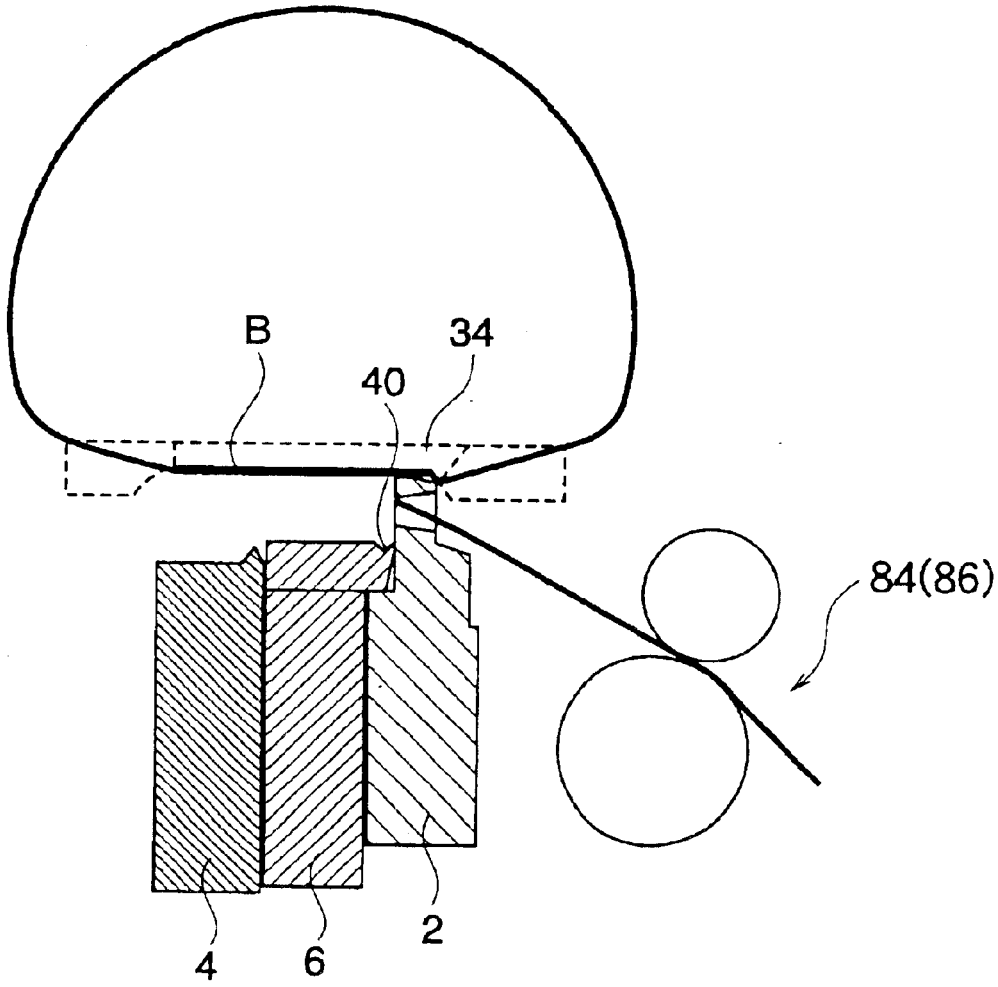
FIG. 7 is a sectional view showing an operation, illustrating the relationship between the state of the idle banded band and the right presser member, the left pressure member, the middle presser member and the like, FIG. 8 is a perspective view showing a conventional automatic banding packing machine.
Figure 8:
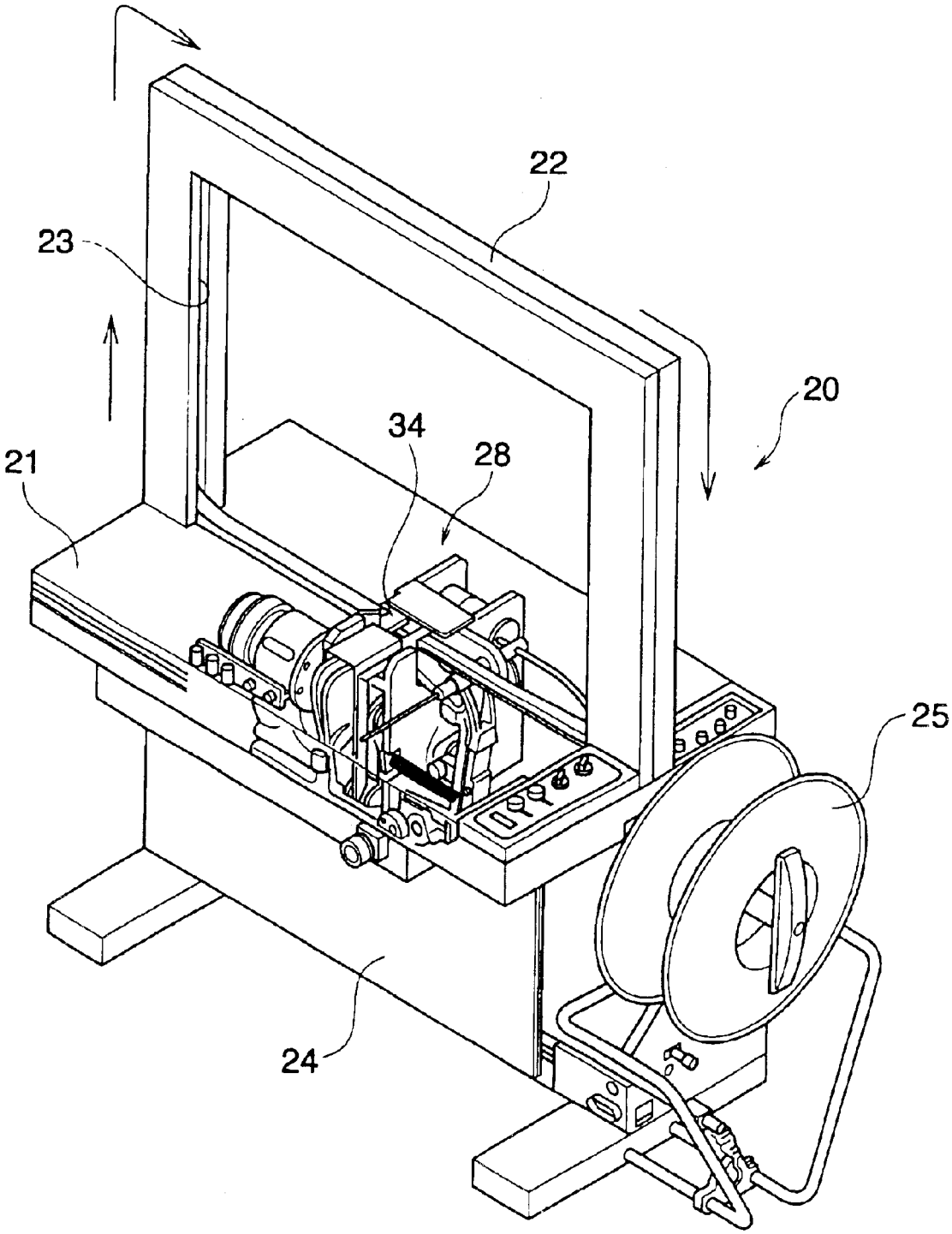
Figure 9:
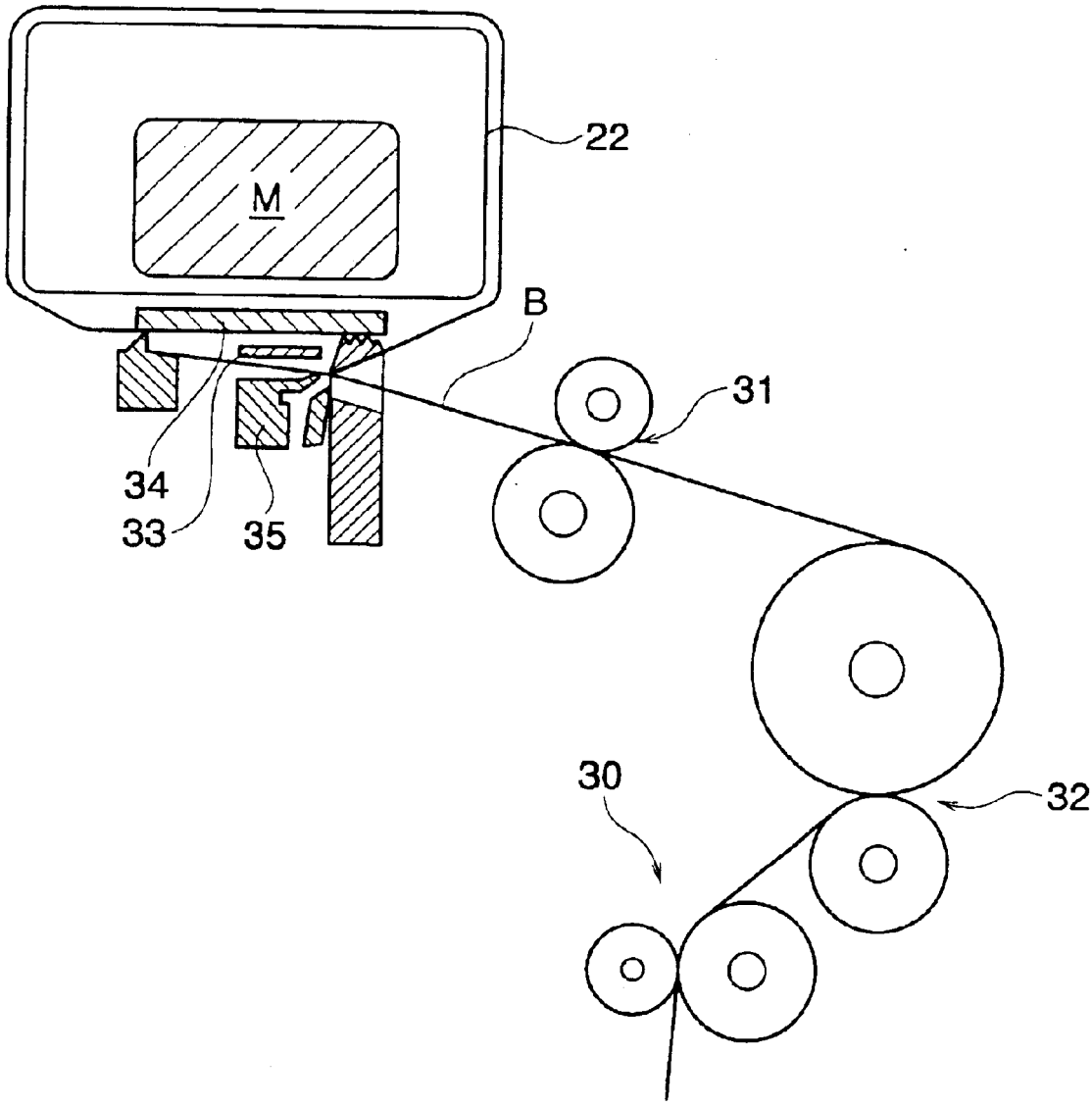
FIG. 9 is a schematic view showing the control portion of the conventional banding packing machine.

In the present embodiment, thus, in the case in which the idle banding is caused, the band is caused to jump outward by the elastic force thereof in the state of FIG. 7 (jump-out).

Moreover, as in the present embodiment, in the case in which such a jump-out mechanism is provided, it is sufficient that a time delay is simply taken in the rotation of the cam shaft 41. Therefore, another member is not required at all and a structure is also very simplified. Accordingly, a cost can also be reduced. Moreover, the number of rotations of the touch roller 88 which is to be set is constant. Even if a repetitive operation is carried out, therefore, a stable operation can be obtained.

While the embodiment of the present invention has been described above, the present invention is not restricted thereto.

For example, while the touch roller 88 is constituted in common to the normal rotating roller 92 or the reverse rotating roller 94 in the embodiment, separate touch rollers may be provided.

As described above, in the automatic banding packing machine according to the present invention, in the case in which the idle banding is carried out, it is sufficient that the rotation of the cam shaft is simply stopped temporarily and other operations are just the same as existing operations. Therefore, a separate member is not required. Accordingly, formation can be carried out inexpensively and a structure can be small-sized.

Moreover, even if the idle banding is carried out, the superposing portion of the band is heated by the heater, and is then cooled sufficiently and is pressed. Therefore, bonding can be prevented.

Accordingly, the band can be caused to jump outward by the elastic force thereof.

What is claimed is:

1. An automatic banding method carried out in an automatic banding packing machine comprising the steps of:

feeding a top portion of a band to a band guide arch by band feeding means;

causing a right presser member, a left presser member and a middle presser member, each of which is arranged below a slide table, to approach or separate from the slide table in a predetermined timing caused by a rotation of a cam shaft, wherein the tip portion of the band is clamped by the right presser member, a rear end side of the band is pulled back by band pull-back means, and the band is tightened by band tightening means, and the band is lifted by the middle presser member and is cut by a cutter, and a heater is inserted to freely appear on a superposing portion of the band, thereby melting a surface of the superposing portion of the band; and further pressing the rear end side of the band by the middle presser member, wherein when the rear end side of the band is to be pulled back by the band pull-back means, an amount of the pull-back is detected by detecting means, and wherein idle banding of the band is carried out when a length of the band thus pulled back is greater than a preset length of the pull-back of the band corresponding to a minimum packed article which can be packed, and the rotation of the cam shaft is temporarily stopped based on a signal, whereby the timing of the pressing to be carried out by the middle presser member, which is operated after melting the superposing portion of the band by means of the heater, is delayed in a predetermined time.

* * * * *